US009846010B2

(12) United States Patent
Pasfield

(10) Patent No.: US 9,846,010 B2
(45) Date of Patent: Dec. 19, 2017

(54) FIREARM SCOPE HEIGHT TOOL

(71) Applicant: Steven Pasfield, Holden Hill (AU)

(72) Inventor: Steven Pasfield, Holden Hill (AU)

( * ) Notice: Subject to any disclaimer, the term of this patent is extended or adjusted under 35 U.S.C. 154(b) by 130 days.

(21) Appl. No.: 15/064,284

(22) Filed: Mar. 8, 2016

(65) Prior Publication Data

US 2016/0265879 A1 Sep. 15, 2016

(30) Foreign Application Priority Data

Mar. 10, 2015 (AU) ..... 2015900852

(51) Int. Cl.
*F41G 1/54* (2006.01)
*F41G 11/00* (2006.01)

(52) U.S. Cl.
CPC ..... *F41G 1/545* (2013.01); *F41G 11/003* (2013.01)

(58) Field of Classification Search
CPC ..... F41G 1/54; F41G 1/545
USPC ..... 33/645
See application file for complete search history.

(56) References Cited

U.S. PATENT DOCUMENTS 870,337 A * 11/1907 Bassell et al. ..... F41G 1/28 42/136
3,486,236 A * 12/1969 Bennett ..... G01B 5/0018 33/519
4,017,995 A * 4/1977 Hughes, Jr. ..... F41G 1/26 42/136
4,161,068 A * 7/1979 McMaster ..... G01B 11/27 33/412
D780,874 S * 3/2017 Pasfield ..... D22/108
2016/0032598 A1* 2/2016 Anderson ..... E04F 21/0092 206/231
2016/0040960 A1* 2/2016 Palmer ..... F41G 1/38 42/120
2016/0054098 A1* 2/2016 Monaghan ..... F41G 1/54 42/141
2016/0252323 A1* 9/2016 Gomez ..... F41G 1/545 42/108

* cited by examiner

*Primary Examiner* — G. Bradley Bennett
(74) *Attorney, Agent, or Firm* — Sand & Sebolt

(57) ABSTRACT

A tool for temporarily fitting a sighting scope to a firearm with a mounting rail. The tool includes a vertically moving slide that is adjusted so that the scope is at the correct height. The height of corresponding scope rings required can then be read from the tool.

12 Claims, 9 Drawing Sheets

FIREARM SCOPE HEIGHT TOOL

FIELD OF THE INVENTION

The present invention relates to firearm accessories, in particular a tool for determining the height of scope rings appropriate for fitting a scope to a firearm. The tool is also suitable for fitting other optical devices such as a red dot sight.

BACKGROUND TO THE INVENTION

Sighting scopes are a useful accessory for a firearm, however firearms are often supplied without a scope leaving the shooter to purchase and fit a scope. A scope is usually fitted to a mounting rail or dovetail on the top of a firearm with the aid of scope rings. Scope rings come in a variety of heights to suit different scope and firearm combinations as well as the preferences of a shooter. A scope ring must support a scope at a sufficient height so that the scope clears the barrel and preferably as low as possible to increase the accuracy of the scope/firearm combination. It is therefore important that the correct height scope rings are chosen, this however is not an easy task. It is common for incorrect scope rings to be selected and purchased. This is both inconvenient for a shooter and a costly exercise if the scope rings cannot be returned to the vendor.

At present there is no easy and reliable method to determine the appropriate height of scope rings to use with a particular firearm and scope combination. A search of online forums for shooters confirms that this is a common problem.

In the first instance a shooter may hold a scope in the appropriate position and attempt to measure the height from the top of the rail to the middle of the scope. This method is fraught with inaccuracies.

Some online calculators exist for determining scope ring height, however these rely on accurate measurements of firearm and scope geometry. Some calculators come with predefined values for some measurements for particular firearms and scopes, however the coverage is not universal and is often limited to particular brands of firearms and scopes that the web site vendor is affiliated with.

The object of this invention is to provide a tool capable of measuring the appropriate height for firearm scope rings to alleviate the above problems, or at least provides the public with a useful alternative.

SUMMARY OF THE INVENTION

In a first aspect the invention comprises tool for temporarily mounting a scope to a mounting rail of a firearm, including a body with a mounting slot to attach the tool to the mounting rail; a slide with a saddle for supporting the scope, the slide vertically movable with respect to the body; and means for measuring the vertical displacement of the saddle with respect to the mounting rail.

Preferably the measuring means comprises a scale on the body and a pointer on the slide, however the scale may be on the slide and a pointer on the body.

The measuring means may also comprise a first shoulder attached to the body and a second shoulder attached to the slide, wherein the first shoulder and second shoulder are vertically displaced from each other equivalent to the vertical displacement of the first saddle with respect to the mounting rail. Alternatively the measuring means comprises a third shoulder attached to the body and a fourth shoulder attached to the slide, wherein the third shoulder and fourth shoulder are vertically displaced from each other equivalent to the vertical displacement of the centre of the scope with respect to the mounting rail.

Preferably the tool further comprises at least one guide slot and the slide comprises at least one guide to restrain movement of the slide with respect to the body, alternatively the body may further comprise at least one guide and the slide comprises at least one guide slot to restrain movement of the slide with respect to the body. In preference the slide is releasably fixable to the body to prevent movement of the slide with respect to the body.

The mounting slot may be adapted to fit to a Picatinny mounting rail or a dovetail.

The slide may further comprise a second saddle and be movable between a first configuration in which the first saddle supports the scope and a second configuration in which the second saddle supports the scope. Preferably one saddle is 1" and one 30 mm.

The tool may further comprise a slide extension with a fifth shoulder horizontally aligned with the fourth shoulder.

It should be noted that any one of the aspects mentioned above may include any of the features of any of the other aspects mentioned above and may include any of the features of any of the embodiments described below as appropriate.

BRIEF DESCRIPTION OF THE DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows.

DRAWING COMPONENTS

Figure 1:
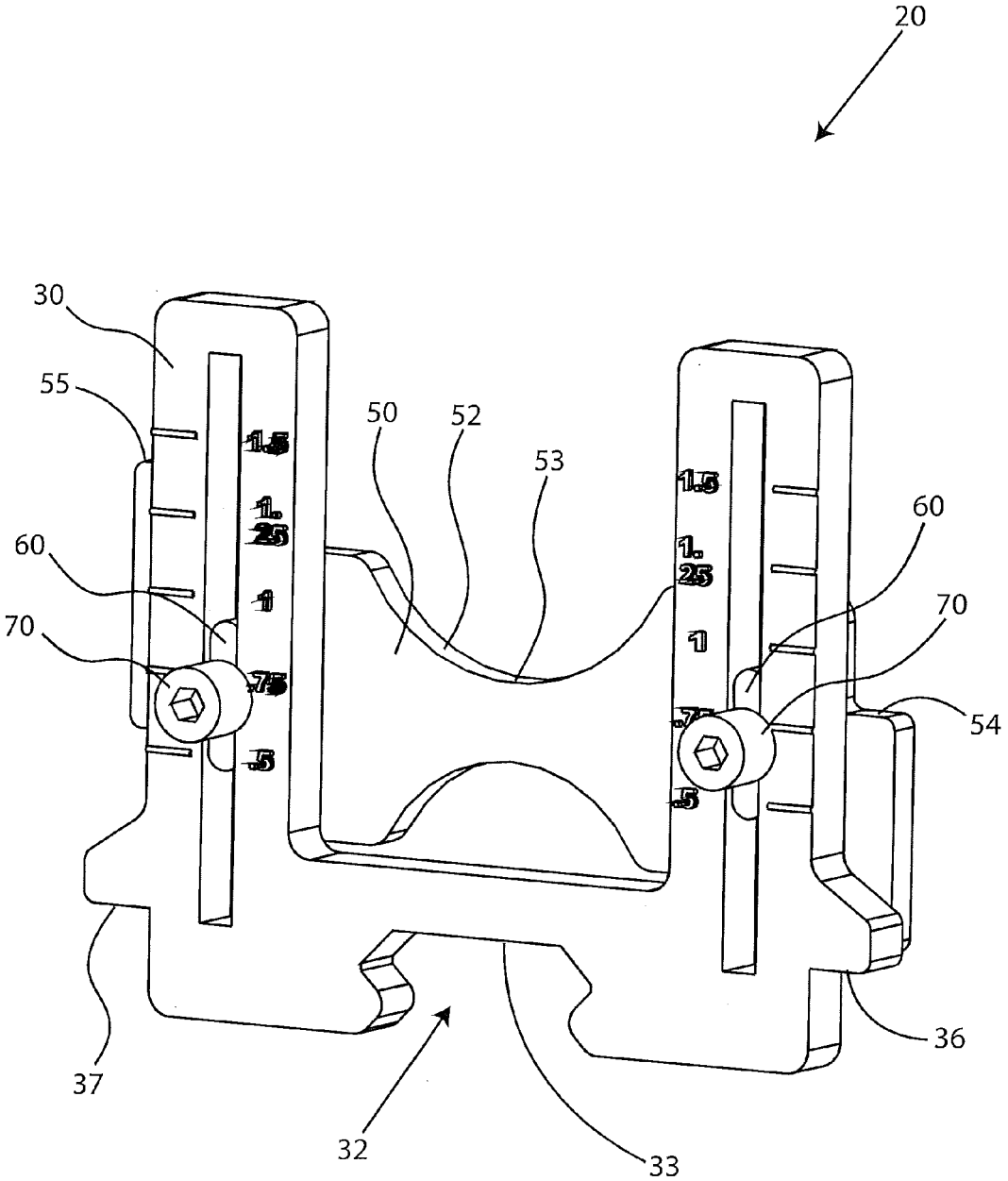
FIG. 1 is a perspective view of a firearm scope height tool according to the present invention suitable for use on a firearm with a Picatinny rail.

The drawings contain the following numbered items:

20 scope height tool (first embodiment)

30 frame

32 mounting slot (Picatinny)
33 mounting slot top
34 slide guide slot
36 height measuring shoulder (saddle height)
37 height measuring shoulder (centre height)
40 scale markers (saddle height)
41 scale indicia (saddle height)
42 scale markers (centre height)
43 scale indicia (centre height)
50 slide
52 large saddle (30 mm)
53 saddle bottom
54 height measuring shoulder (saddle height)
55 height measuring shoulder (centre height)
56 small saddle (1")
57 saddle bottom
58 height measuring shoulder (saddle height)
59 height measuring shoulder (centre height)
60 guide
64 guide nut
70 thumb screw
80 scope height tool (second embodiment)
82 mounting slot (dovetail)
90 firearm
92 Picatinny rail
94 sighting scope
200 scope height tool (further embodiment)
250 slide extension
255 scope centre height measuring shoulder (for 1" scopes)
259 scope centre height measuring shoulder (for 30 mm scopes)

DETAILED DESCRIPTION OF THE INVENTION

The following detailed description of the invention refers to the accompanying drawings. Wherever possible, the same reference numbers will be used throughout the drawings and the following description to refer to the same and like parts. Dimensions of certain parts shown in the drawings may have been modified and/or exaggerated for the purposes of clarity or illustration.

The present invention provides a tool that allows the correct height scope rings to be chosen for a particular firearm and scope combination. The tool fits in place of scope rings, allowing a scope to be temporarily mounted on to a firearm. The tool is then adjusted to a particular ring height for evaluation or adjusted for best scope fit and then the required ring height is read from the tool. The drawings depict the tool in use with a rifle, however it is to be understood that the tool is suitable for any firearm to which a scope may be fitted.

The tool is discussed primarily for use with Picatinny rails as defined in standard MIL-STD-1913, but will also work with Weaver rails on which the Picatinny standard is based. The tool works with rails that are either integral to the firearm or fitted to one. A further embodiment of the invention is suitable for use with dovetails that may be cut into the top of a firearm. For the sake of brevity the tool will be primarily discussed in conjunction with a Picatinny rail, however this is to be understood to be applicable to other types of rails and mounts as discussed above which will be generically referred to as "mounting rails".

Figure 2:
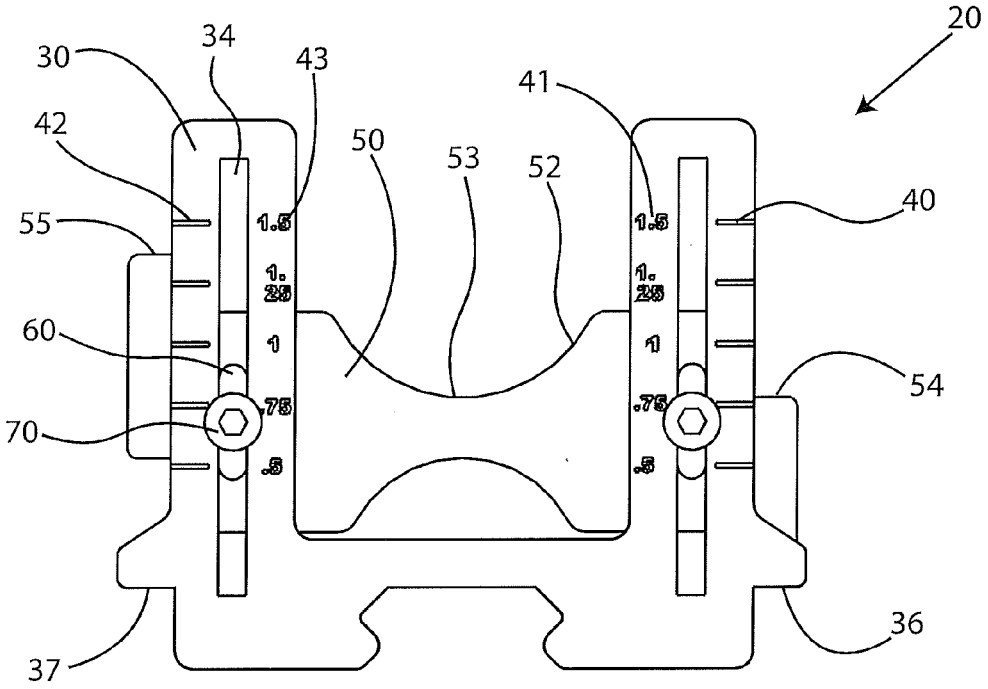
FIG. 2 shows the tool of FIG. 1 from a front view.
Figure 3:
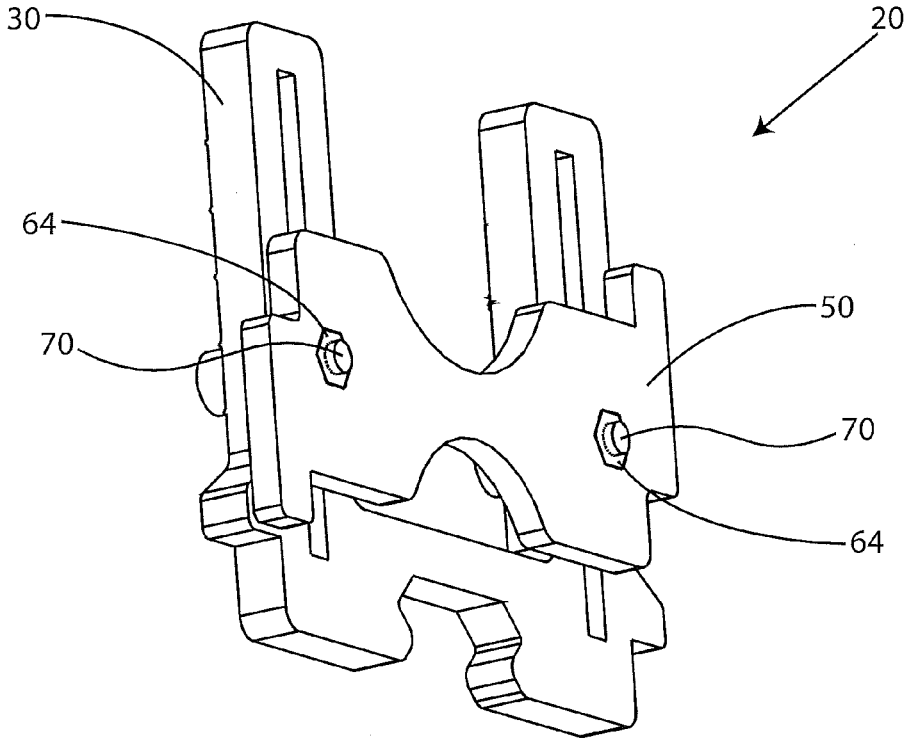
FIG. 3 shows the tool of FIG. 1 from a rear perspective view.
Figure 13:
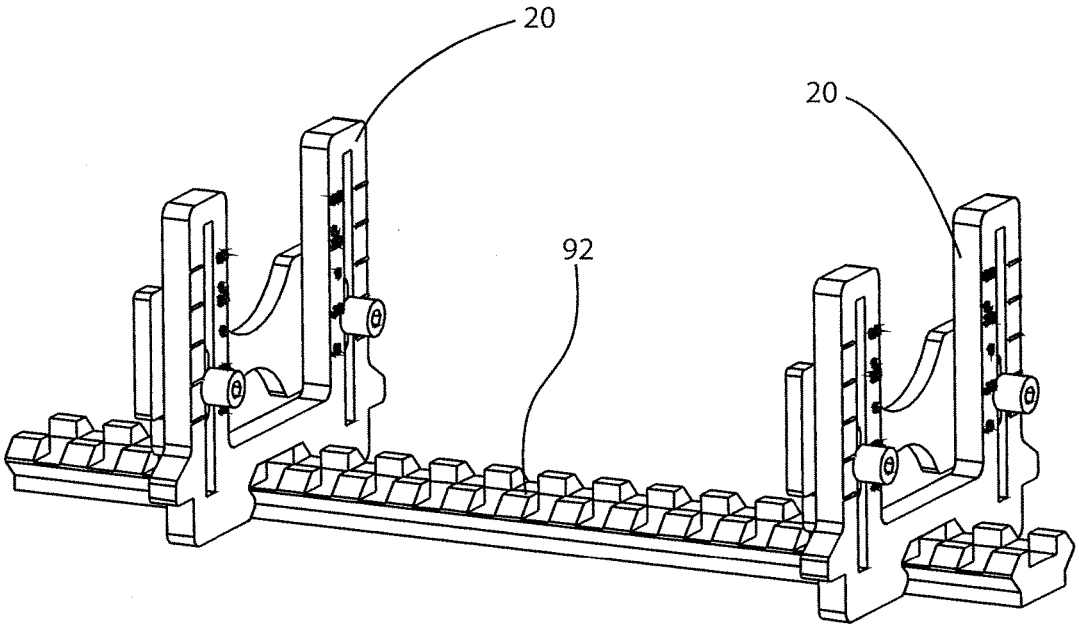
FIG. 13 is a close up view of a Picatinny rail with the tool fitted.

A first embodiment of a firearm scope height tool according to the present invention is shown as 20 in front perspective view in FIG. 1, front on in FIG. 2 and in a rear perspective view in FIG. 3. The tool comprises a generally u-shaped frame 30 and a slide 50 which can move up and down with respect to the frame. Thumb screws 70 serve to secure the slide at the desired height. The frame includes a mounting slot 32 that attaches the tool to a Picatinny rail on the top of a firearm (as seen in FIG. 13) and the slide provides a saddle 52 to support the barrel of a sighting scope.

The movement of slide 50 is restrained by guides 60 that are retained by slots 34 in the frame 30. The combination allows only vertical movement of the slide. Screws 70 pass through holes in the guides to engage with nuts 64 embedded in the slide 50. The screws serve to retain the slide to the frame and when tightened also prevent vertical movement of the slide. The slide is set in a desired position, or its position measured with aid of scale markers 40, 42 and scale indicia 41, 43. The screws 70 also indicate the position on the scales. The scales are in imperial units as most scope rings are made to imperial measurements. In further embodiments metric scales or both types of scales are used. The tool incorporates two scales: 40, 41 to measure the distance from the top of the mounting rail to the bottom of the saddle; and 42, 43 to measure the distance from the top of the mounting rail to the centre of the scope sitting in the saddle 52. The height to the centre of the scope is more commonly used and corresponds with the height of the scope rings needed to mount a scope at the same height as achieved when using the tool. The scales are provided in increments of ¼" and can be readily interpolated by eye for intermediate values. If a more precise measurement is required, a ruler or callipers can be used to measure the distance between height measuring shoulders 36 and 54 for the saddle bottom height and between height measuring shoulders 37 and 55 for the sight centre height. Shoulders 36 and 37 are provided on the frame and align with the top 33 of the mounting slot. Shoulder 54 is provided on the slide and aligns with the bottom 53 of the saddle 52, whilst shoulder 55 aligns with the centre of a scope sitting in the saddle 52.

Figure 4:
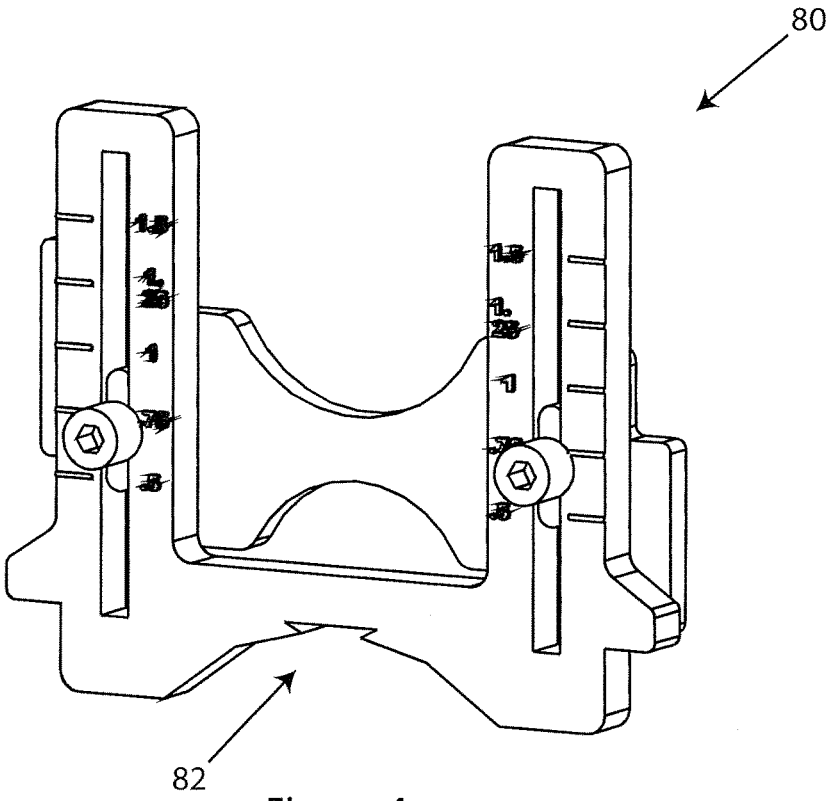
FIG. 4 shows a perspective view of an embodiment of the tool suitable for use on a firearm with a dovetail.
Figure 5:
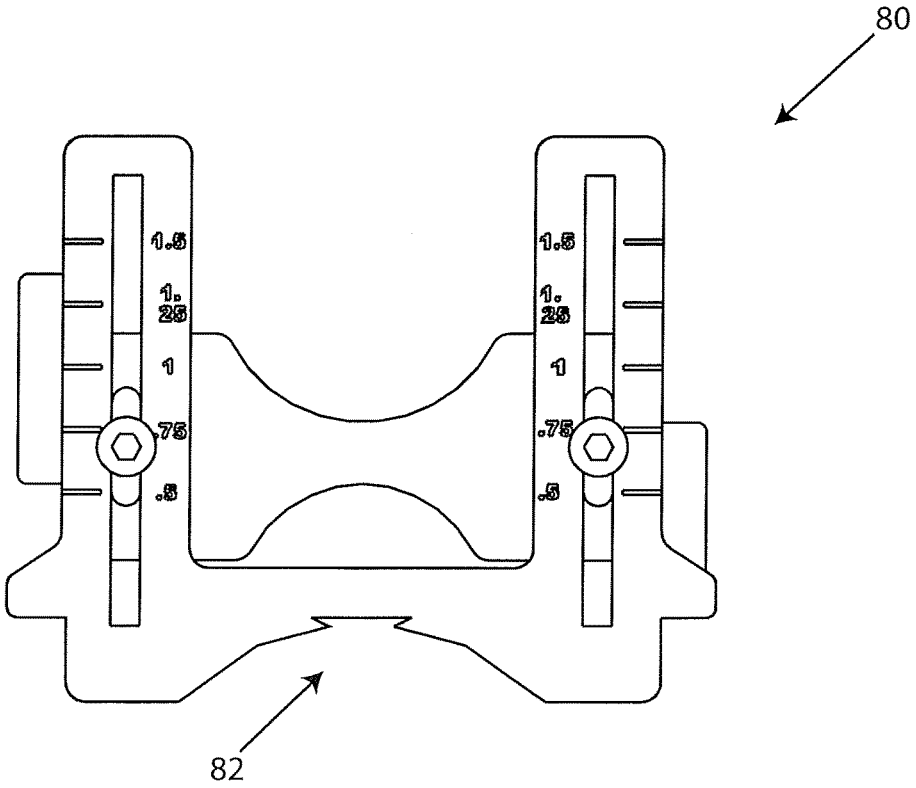
FIG. 5 shows the tool of FIG. 4 from a front view.

A second embodiment of the tool is shown as 80 in FIG. 4 from a perspective view and in FIG. 5 from front on. The tool 80 differs from the tool 20 in having a mounting slot 82 suitable for use with a dovetail (as opposed to the mounting slot 32 for use with Picatinny rails).

Figure 6:
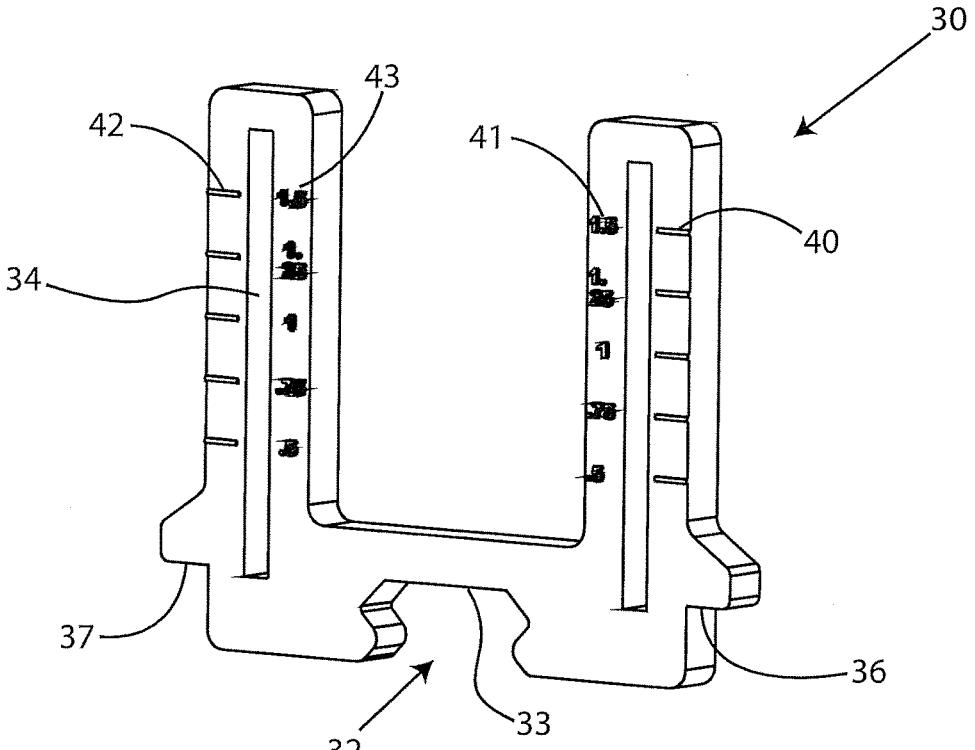
FIG. 6 shows the frame of the tool from a front perspective view.
Figure 7:
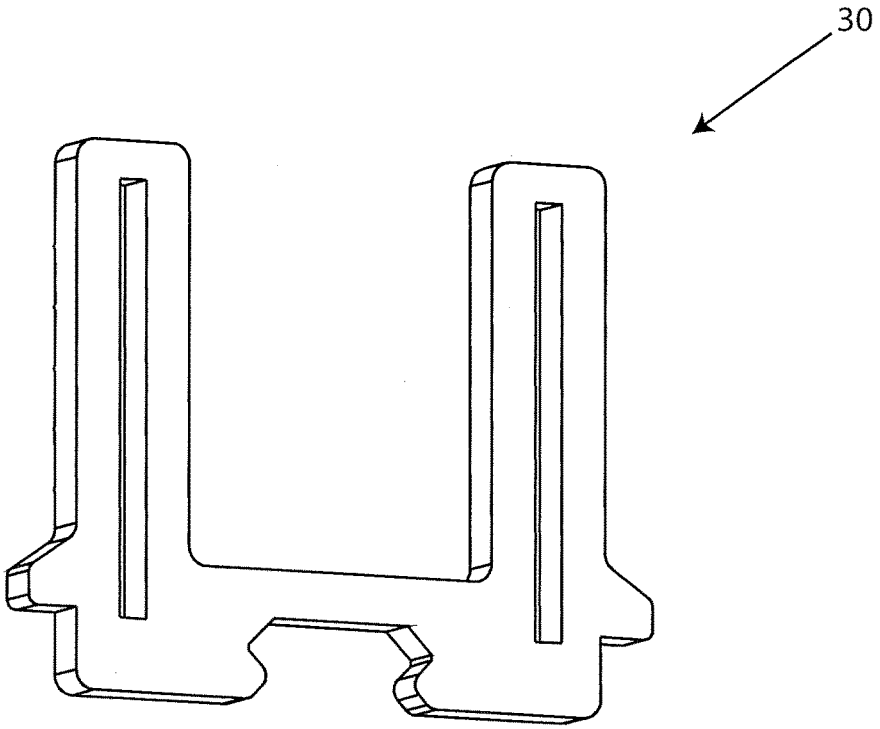
FIG. 7 shows the frame of the tool from a rear perspective view.

FIGS. 6 and 7 show the frame 30 of the tool in isolation from front and rear perspective views.

Figure 8:
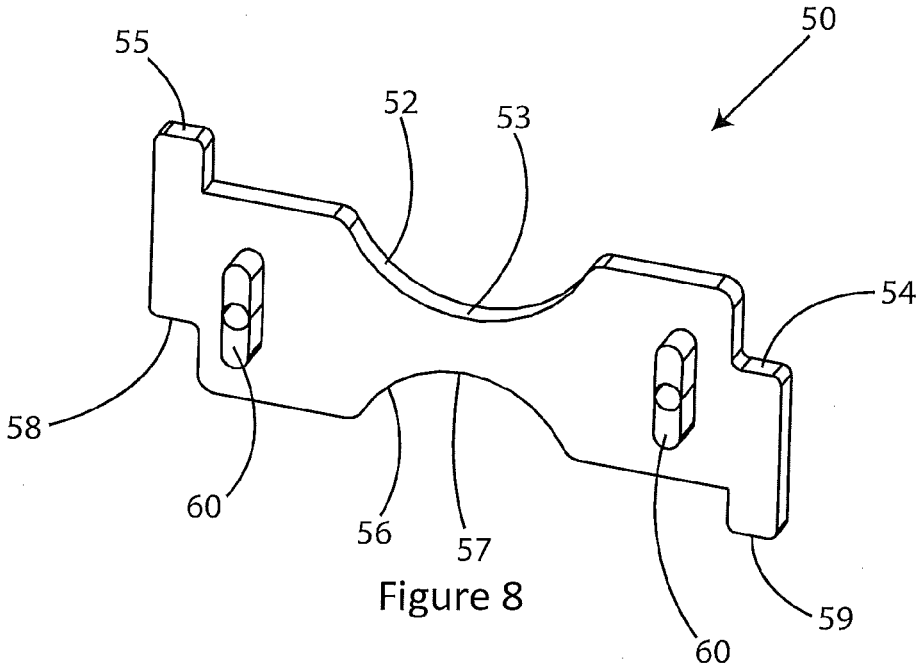
FIG. 8 shows the saddle of the tool from a front perspective view.
Figure 9:
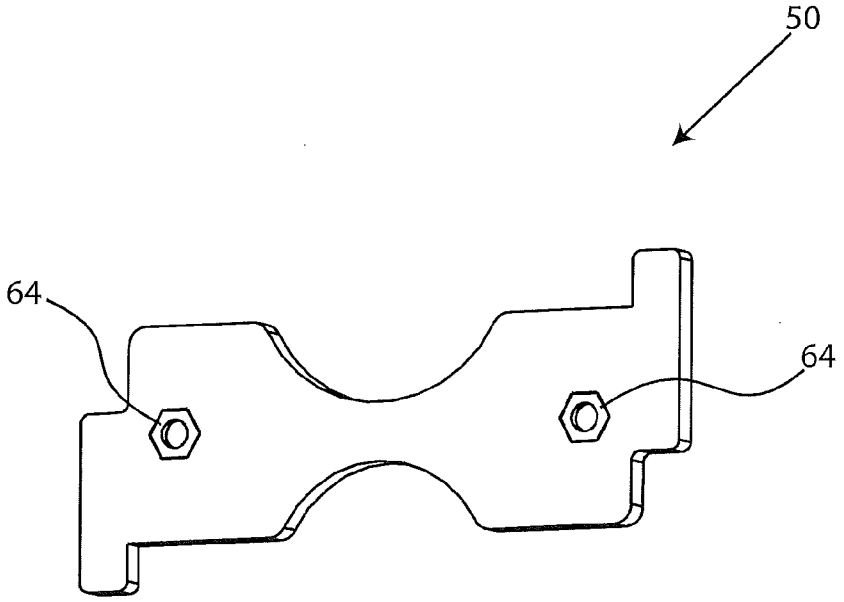
FIG. 9 shows the saddle of the tool from a rear perspective view.

FIGS. 8 and 9 show the slide 50 of the tool from front and rear perspective views. The slide may be used in a first orientation (as shown) with the large saddle 52 uppermost, or rotated by 180° in which case the smaller saddle 56 is uppermost. The tool may consequently be used with two different sizes of scopes. Saddle 52 is for use with 1" scopes and saddle 56 is for use with 30 mm scopes, but may also be used with other sized scopes in which case a suitable offset will need to be added to the measured height. The height measuring shoulders 54 and 58 align with the respective saddle bottoms 53 and 57, whilst the height measuring shoulders 55 and 59 align with the respective centres of the scopes sitting in the saddles.

Figure 10:
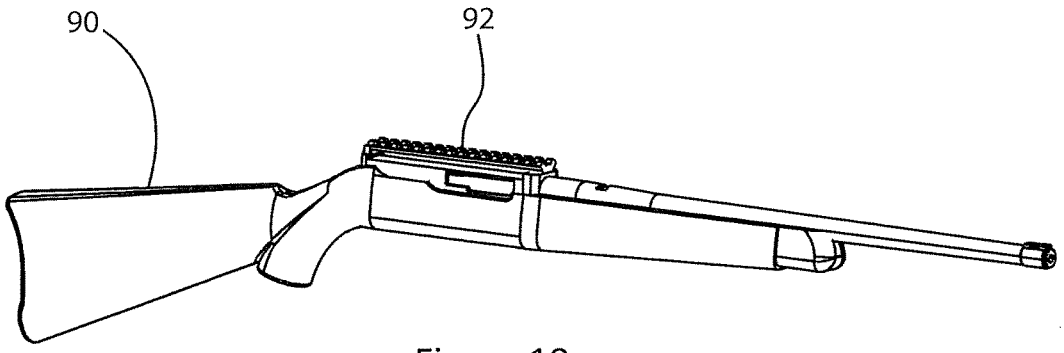
FIG. 10 shows a firearm fitted with a Picatinny rail.
Figure 11:
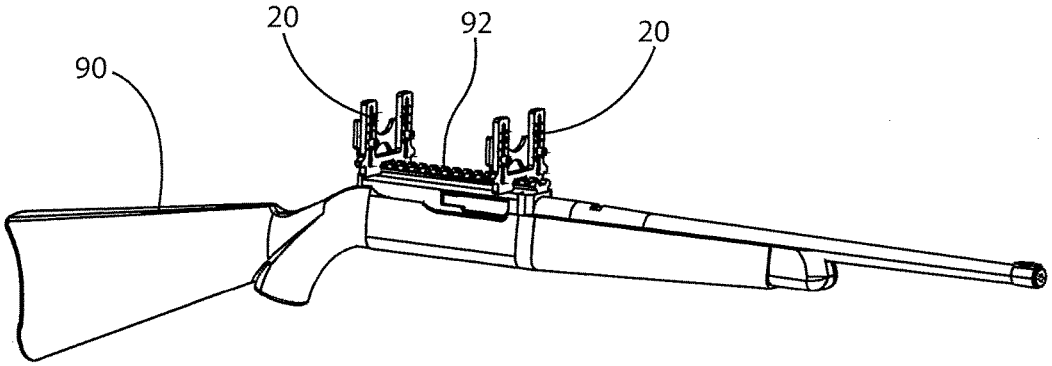
FIG. 11 shows the firearm of FIG. 10 fitted with the tool.
Figure 12:
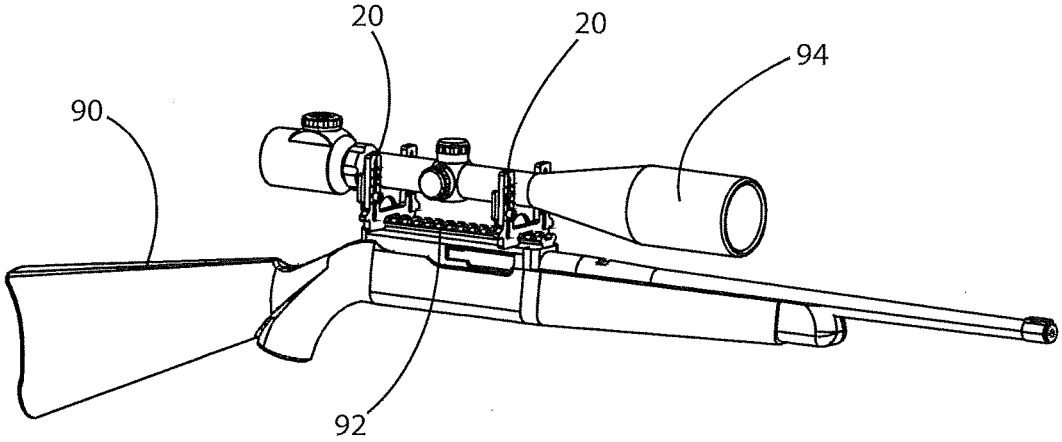
FIG. 12 shows the firearm of FIG. 10 fitted with a scope.

FIGS. 10 to 12 illustrate how a scope may be fitted to a firearm with the aid of the tool in order to determine the appropriate height of scope rings for the particular scope and firearm combination. FIG. 10 shows a firearm 90 with a Picatinny rail 92. Two of the tools 20 are then slid onto the Picatinny rails as shown in FIG. 11. The scope 94 is then placed onto the tools 20 as shown in FIG. 12. The height of the scope is then checked by the shooter to ensure that it clears the barrel of the firearm and is at comfortable height for use, preferably with the scope as close as possible to the barrel of the firearm. The height of the tools is either set to a particular value before the scope is fitted, allowing the suitability of particular scope rings to be checked, or adjusted until the scope is at a desired height, after which the height is read or measured from the tool. If the height thus determined does not correspond to an available ring height then a higher or lower available ring height can be selected. The shooter then has the option of adjusting the tool to the available heights to see which is preferred. Subsequently there will be no unpleasant surprises for the shooter when they buy and fit actual scope rings as they will mount the scope at exactly the same height as was tested with the tool.

Figure 14:
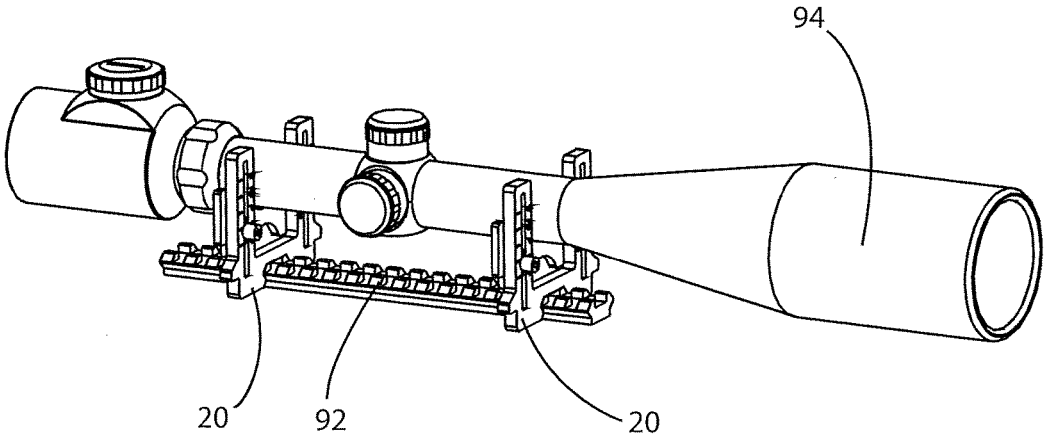
FIG. 14 is a close up view of a Picatinny rail fitted with the tool and a scope.

FIGS. 13 and 14 provide close up views of the tools fitted to a Picatinny rail, without (FIG. 13) and with (FIG. 14) a scope fitted.

Figure 15:
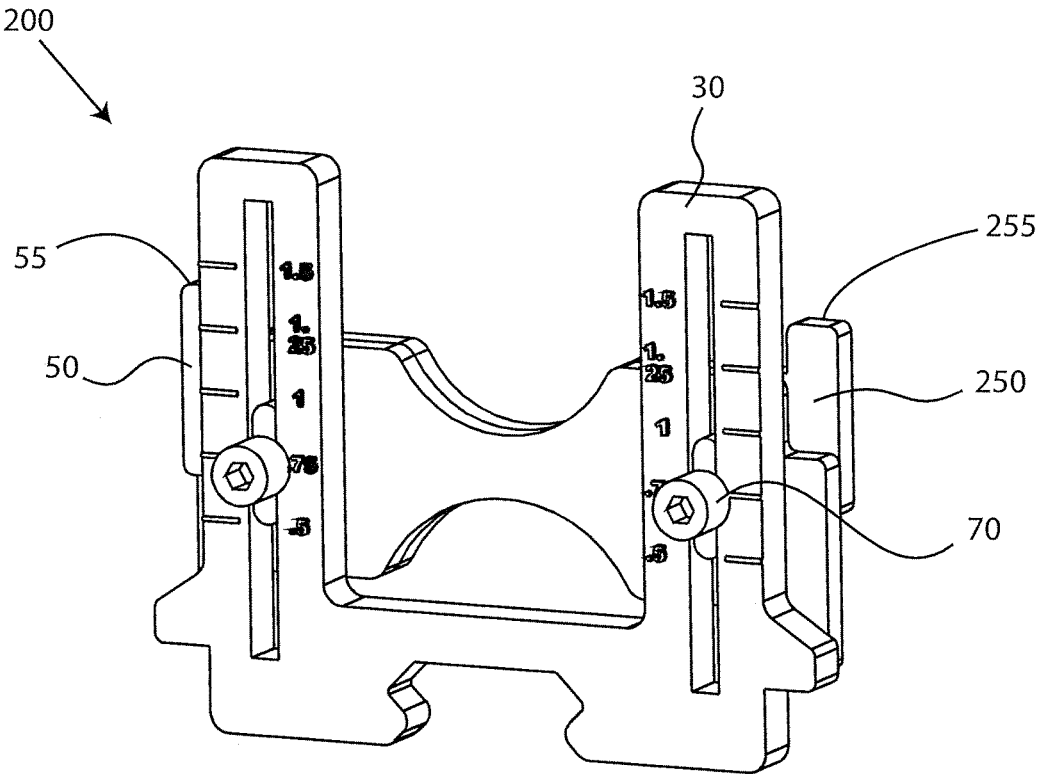
FIG. 15 shows a scope height tool according to a further embodiment from a front perspective view.
Figure 16:
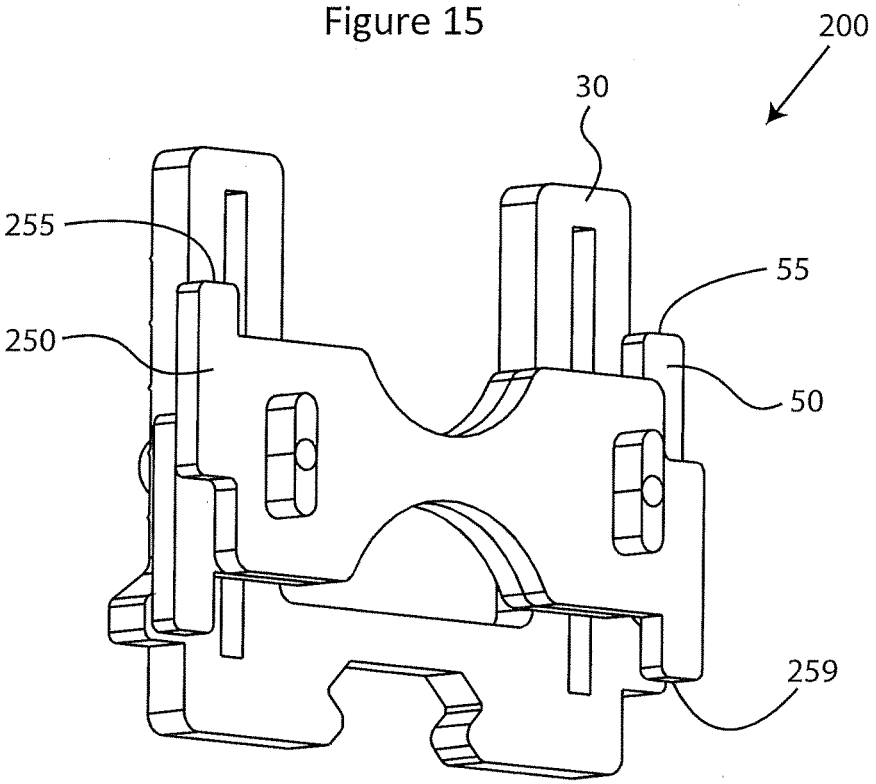
FIG. 16 shows the tool of FIG. 15 from a rear perspective view.
Figure 17:
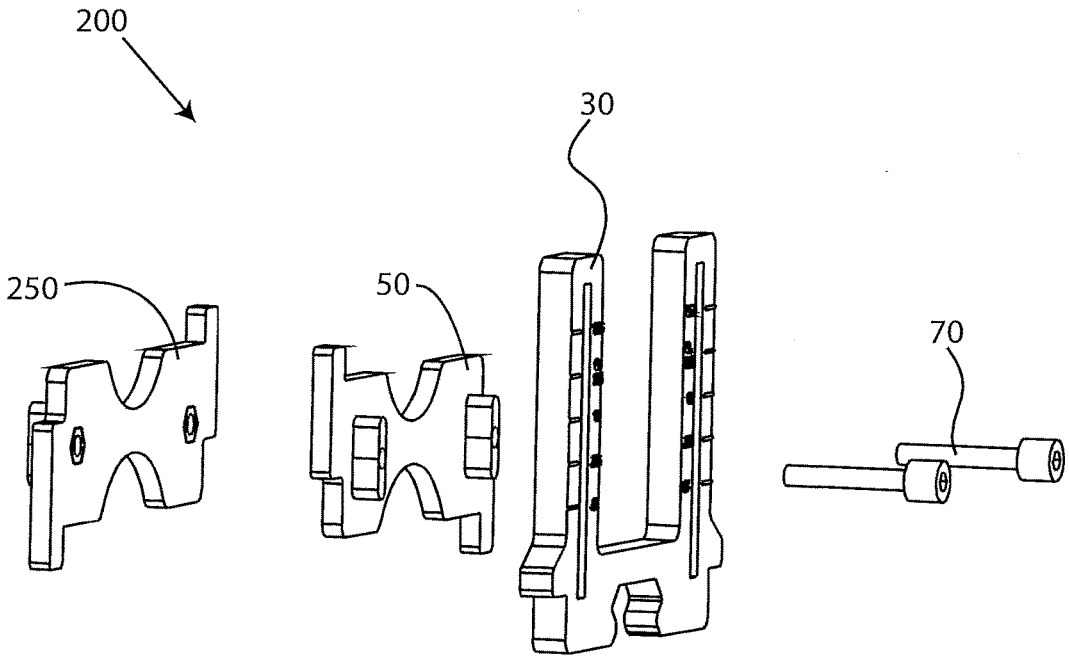
FIG. 17 shows an exploded view of the tool of FIG. 15.

A further embodiment of the invention is shown as 200 in FIGS. 15 to 17 including a slide extension 250 to provide a second shoulder 255 at scope centre height. The further embodiment is seen in front perspective view in FIG. 15, rear perspective view in FIG. 16 and in an exploded view in FIG. 17. The slide extension 250 is similar in structure to the first slide 50, and is attached to the rear of the slide 50 via the thumbscrews 70. The slide extension still allows the slide to be fitted in a first orientation for 1" scopes and an inverted orientation for 30 mm scopes in which case the second scope centre shoulder 259 comes into play.

The invention also encompasses mechanical equivalents of the exemplary embodiments presented above. In one further embodiment (not shown) the indicia and scale are provided on the slide and a pointer on the body to measure the ring height. In a yet further embodiment (not shown) the position of the guides and guide slots are reversed between the body and the slide.

The reader will now appreciate the present invention which provides a tool for temporarily fitting a scope to a firearm to accurately determine the height of scope rings to use with a particular firearm/scope combination.

Further advantages and improvements may very well be made to the present invention without deviating from its scope. Although the invention has been shown and described in what is conceived to be the most practical and preferred embodiment, it is recognized that departures may be made therefrom within the scope of the invention, which is not to be limited to the details disclosed herein but is to be accorded the full scope of the claims so as to embrace any and all equivalent devices and apparatus. Any discussion of the prior art throughout the specification should in no way be considered as an admission that such prior art is widely known or forms part of the common general knowledge in this field.

In the present specification and claims (if any), the word "comprising" and its derivatives including "comprises" and "comprise" include each of the stated integers but does not exclude the inclusion of one or more further integers.

The invention claimed is:

1. A tool for temporarily mounting a scope to a mounting rail of a firearm, the tool comprising:

a body with a mounting slot to attach the tool to the mounting rail;

a slide with a first saddle for supporting the scope, the slide vertically movable with respect to the body; and means for measuring the vertical displacement of the first saddle with respect to the mounting rail.

2. The tool as in claim 1, wherein the measuring means comprises a scale on the body and a pointer on the slide.

3. The tool as in claim 1, wherein the measuring means comprises a scale on the slide and a pointer on the body.

4. The tool as in claim 1, wherein the measuring means comprises a first shoulder attached to the body and a second shoulder attached to the slide, and wherein the first shoulder and second shoulder are vertically displaced from each other equivalent to the vertical displacement of the first saddle with respect to the mounting rail.

5. The tool as in claim 1, wherein the measuring means comprises a third shoulder attached to the body and a fourth shoulder attached to the slide, and wherein the third shoulder and fourth shoulder are vertically displaced from each other equivalent to the vertical displacement of the centre of the scope with respect to the mounting rail.

6. The tool as in claim 1, wherein the body further comprises at least one guide slot and the slide comprises at least one guide to restrain movement of the slide with respect to the body.

7. The tool as in claim 1, wherein the body further comprises at least one guide and the slide comprises at least one guide slot to restrain movement of the slide with respect to the body.

8. The tool as in claim 1, wherein the slide is releasably fixable to the body to prevent movement of the slide with respect to the body.

9. The tool as in claim 1, wherein the mounting slot is adapted to fit to a Picatinny mounting rail.

10. The tool as in claim 1, wherein the mounting slot is adapted to fit to a dovetail.

11. The tool as in claim 1, wherein the slide further comprises a second saddle and wherein the slide is movable between a first configuration in which the first saddle supports the scope and a second configuration in which the second saddle supports the scope.

12. The tool as in claim 1, further comprising a slide extension, wherein the slide extension comprises a fifth shoulder horizontally aligned with the fourth shoulder.

* * * * *